US010801741B2

(12) United States Patent
Kim et al.

(10) Patent No.: US 10,801,741 B2
(45) Date of Patent: Oct. 13, 2020

(54) AIR-CONDITIONING SYSTEM

(71) Applicant: SAMSUNG ELECTRONICS CO., LTD., Suwon-si, Gyeonggi-do (KR)

(72) Inventors: Tae Il Kim, Hwaseong-si (KR); Mun Sub Kim, Suwon-si (KR); Tae Woo Kang, Suwon-si (KR); Hyeon U Park, Suwon-si (KR); Wang Byung Chae, Yongin-si (KR); Kyung Hoon Kim, Suwon-si (KR); Sung Goo Kim, Suwon-si (KR); Hyeong Joon Seo, Suwon-si (KR); Hyun Wuk Kang, Suwon-si (KR); Jin Yong Mo, Anyang-si (KR); Il Yong Cho, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 74 days.

(21) Appl. No.: 15/765,657

(22) PCT Filed: Oct. 18, 2016

(86) PCT No.: PCT/KR2016/011690
§ 371 (c)(1),
(2) Date: Apr. 3, 2018

(87) PCT Pub. No.: WO2017/069487
PCT Pub. Date: Apr. 27, 2017

(65) Prior Publication Data

US 2019/0078795 A1 Mar. 14, 2019

(30) Foreign Application Priority Data

Oct. 23, 2015 (KR) ..... 10-2015-0147978

(51) Int. Cl.
*F24F 1/28* (2011.01)
*F25B 41/04* (2006.01)
(Continued)

(52) U.S. Cl.
CPC ..... *F24F 1/28* (2013.01); *F24F 1/00* (2013.01); *F24F 1/06* (2013.01); *F24F 11/89* (2018.01);
(Continued)

(58) Field of Classification Search
CPC ..... F24F 1/28; F24F 11/89; F24F 1/00; F24F 1/06; F25B 1/00; F25B 13/00;
(Continued)

(56) References Cited

U.S. PATENT DOCUMENTS

2005/0178149 A1* 8/2005 Ikegami ..... F25B 41/00 62/500
2006/0101845 A1* 5/2006 Jeong ..... F25B 31/004 62/470
2011/0262267 A1 10/2011 Walters

FOREIGN PATENT DOCUMENTS

CN 1209534 3/1999
CN 1776227 5/2006
(Continued)

OTHER PUBLICATIONS

Partial European Search Report dated Jul. 17, 2018 from European Patent Application No. 16857745.0, 14 pages.
(Continued)

*Primary Examiner* — Elizabeth J Martin
(74) *Attorney, Agent, or Firm* — Staas & Halsey LLP

(57) ABSTRACT

In an air-conditioning system, a gaseous refrigerant remaining in a reservoir can be discharged from the reservoir even when a cooling operation has started and the reservoir is
(Continued)

being filled with a liquid refrigerant. Therefore, the reservoir can be filled with the liquid refrigerant at a faster speed.

2 Claims, 10 Drawing Sheets

(51) Int. Cl.

| | |
|---|---|
| ***F24F 11/89*** | (2018.01) |
| ***F25B 13/00*** | (2006.01) |
| ***F25B 41/00*** | (2006.01) |
| ***F24F 1/06*** | (2011.01) |
| ***F24F 1/00*** | (2019.01) |
| ***F25B 41/06*** | (2006.01) |
| ***F25B 43/00*** | (2006.01) |
| ***F25B 1/00*** | (2006.01) |

(52) U.S. Cl.
CPC ..... *F25B 1/00* (2013.01); *F25B 13/00* (2013.01); *F25B 41/003* (2013.01); *F25B 41/04* (2013.01); *F25B 41/06* (2013.01); *F25B 41/062* (2013.01); *F25B 43/00* (2013.01); *F25B 43/003* (2013.01); *F25B 43/006* (2013.01); *F25B 2313/005* (2013.01); *F25B 2313/006* (2013.01); *F25B 2313/0233* (2013.01); *F25B 2400/16* (2013.01); *F25B 2700/2113* (2013.01)

(58) Field of Classification Search
CPC ..... F25B 41/003; F25B 41/04; F25B 41/06; F25B 41/43; F25B 41/00; F25B 43/003; F25B 43/006; F25B 2313/006; F25B 2313/005; F25B 2313/0233; F25B 2400/16; F25B 2700/2133
See application file for complete search history.

(56) References Cited

FOREIGN PATENT DOCUMENTS

| | | |
|---|---|---|
| CN | 200965387 | 10/2007 |
| CN | 103808091 | 5/2014 |
| CN | 104990307 | 10/2015 |
| EP | 1 659 350 | 5/2006 |
| KR | 0132133 | 3/1999 |
| KR | 20050107086 | * 7/2004 |
| KR | 10-2005-0107086 | 11/2005 |
| KR | 10-2006-0055154 | 5/2006 |
| KR | 10-0624811 | 9/2006 |
| KR | 10-2014-0060699 | 5/2014 |
| KR | 10-2014-0098227 | 8/2014 |

OTHER PUBLICATIONS

Extended European Search Report dated Oct. 22, 2018 from European Patent Application No. 16857745.0, 13 pages.
Information on Search Strategy (EPO Form P04A42) from European Patent Application No. 16857745.0, 1 page.
Written Opinion of the International Searching Authority dated Dec. 14, 2016 in corresponding International Patent Application No. PCT/KR2016/011690.
International Search Report dated Dec. 14, 2016 in corresponding International Patent Application No. PCT/KR2016/011690.
European Communication dated Dec. 10, 2019 in European Patent Application No. 16857745.0.
Chinese Office Action dated Sep. 27, 2019 in Chinese Patent Application No. 201680061768.7.

* cited by examiner

【Fig. 1】
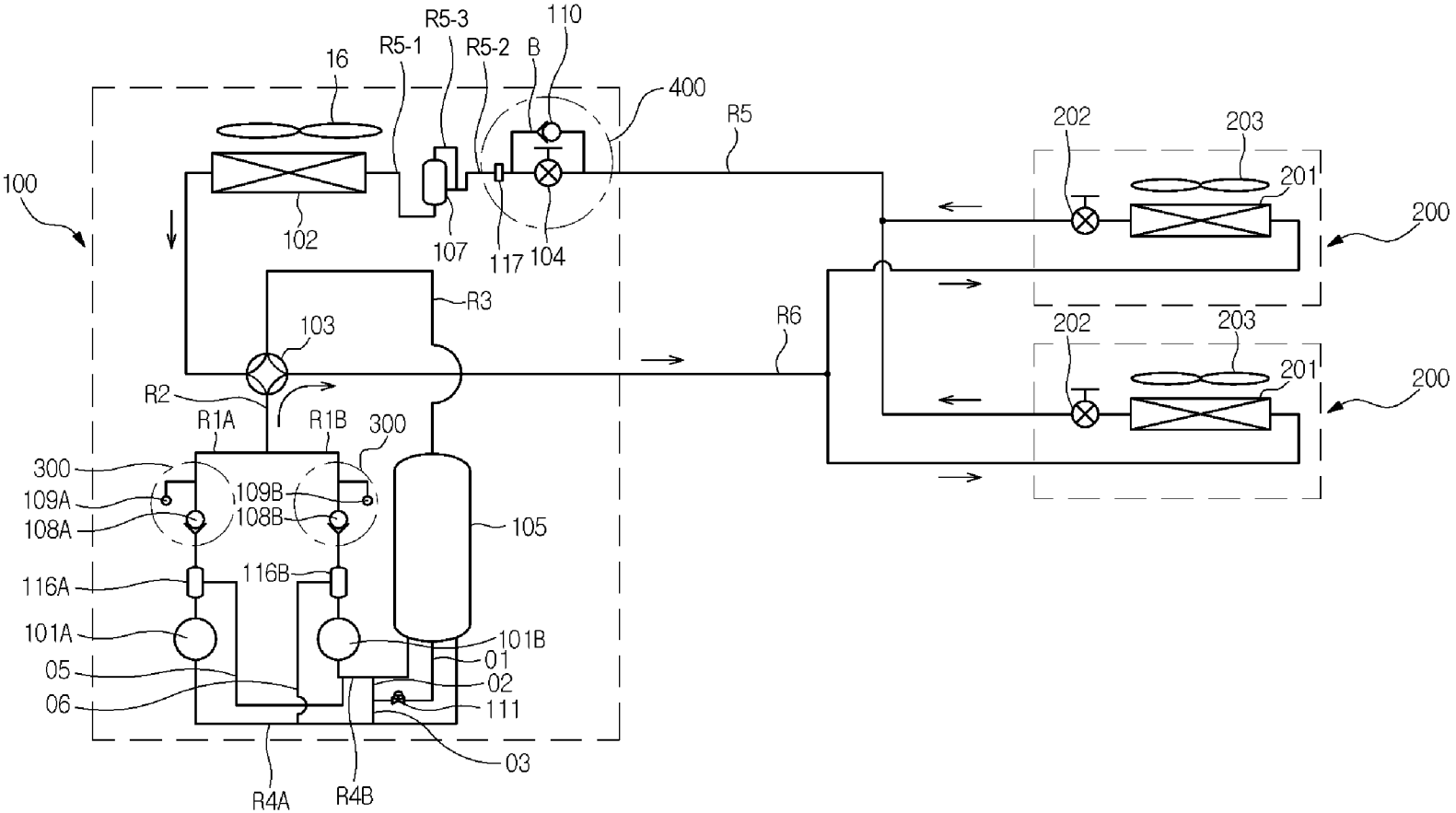

【Fig. 2】
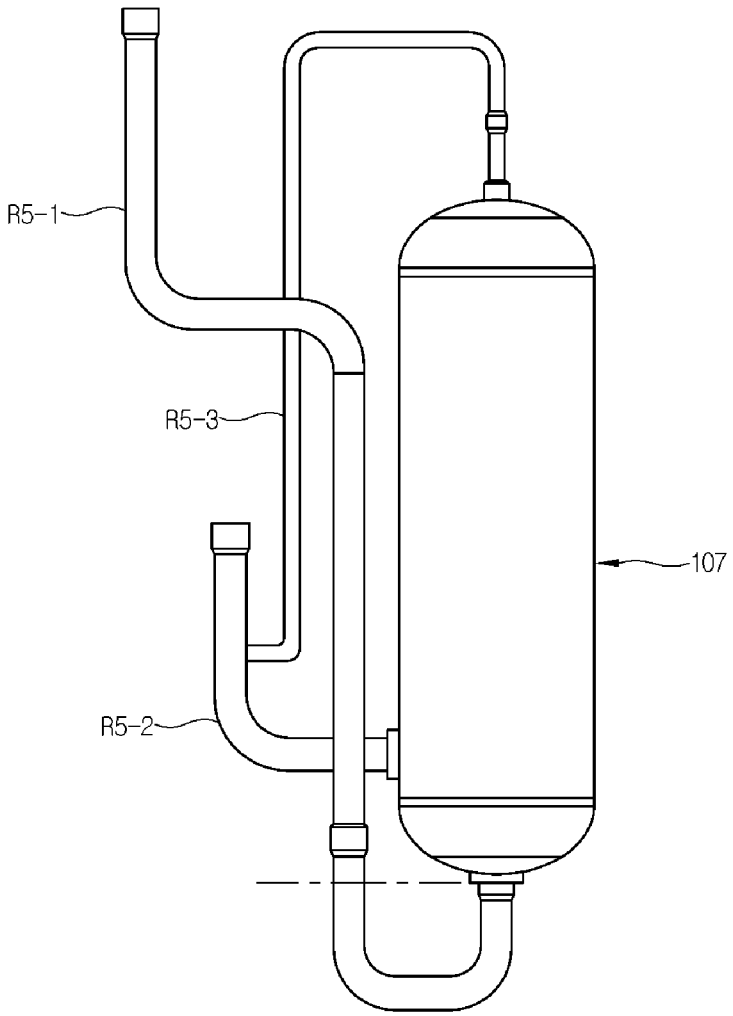

【Fig. 3】
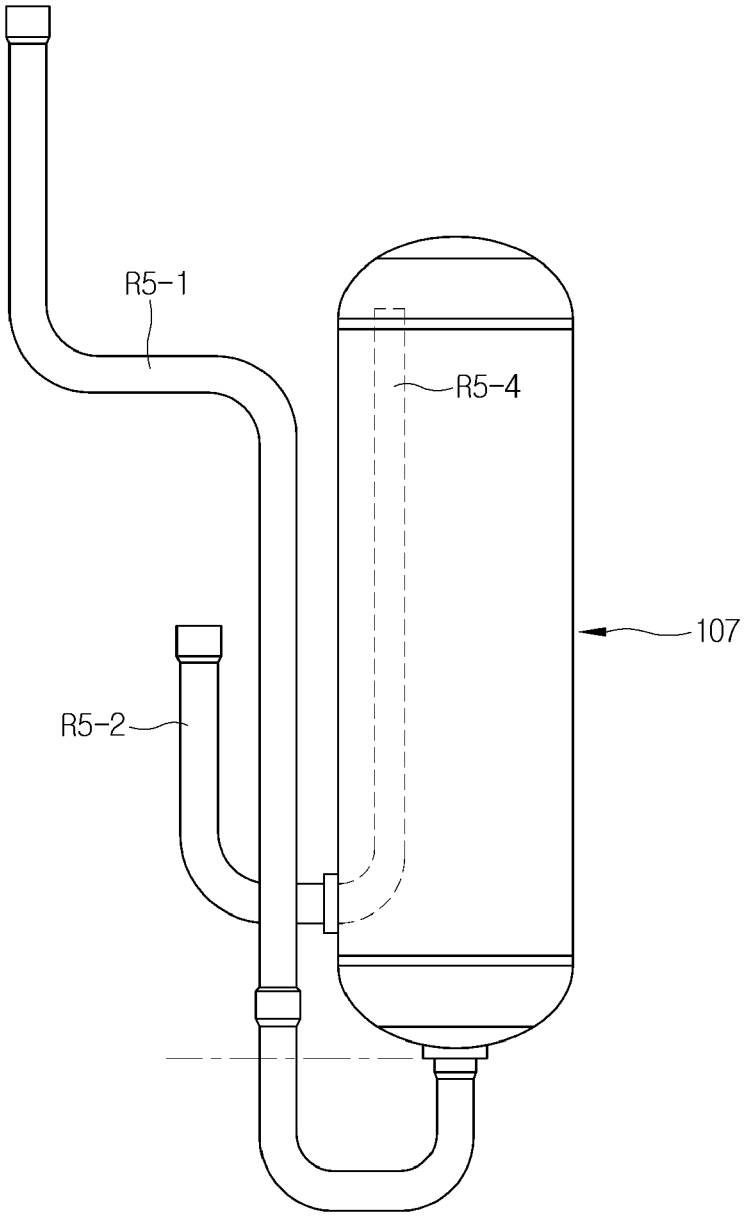

【Fig. 4】
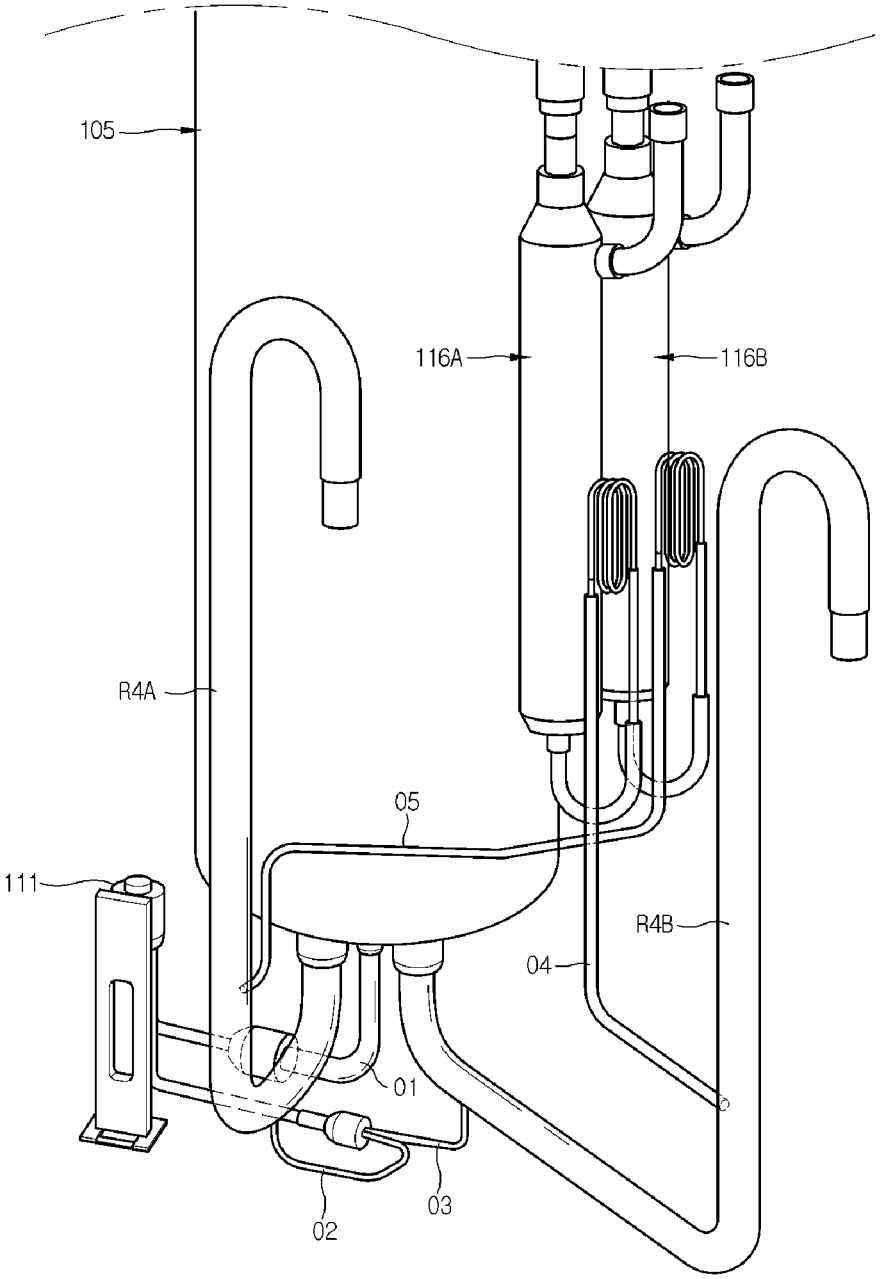

【Fig. 5】
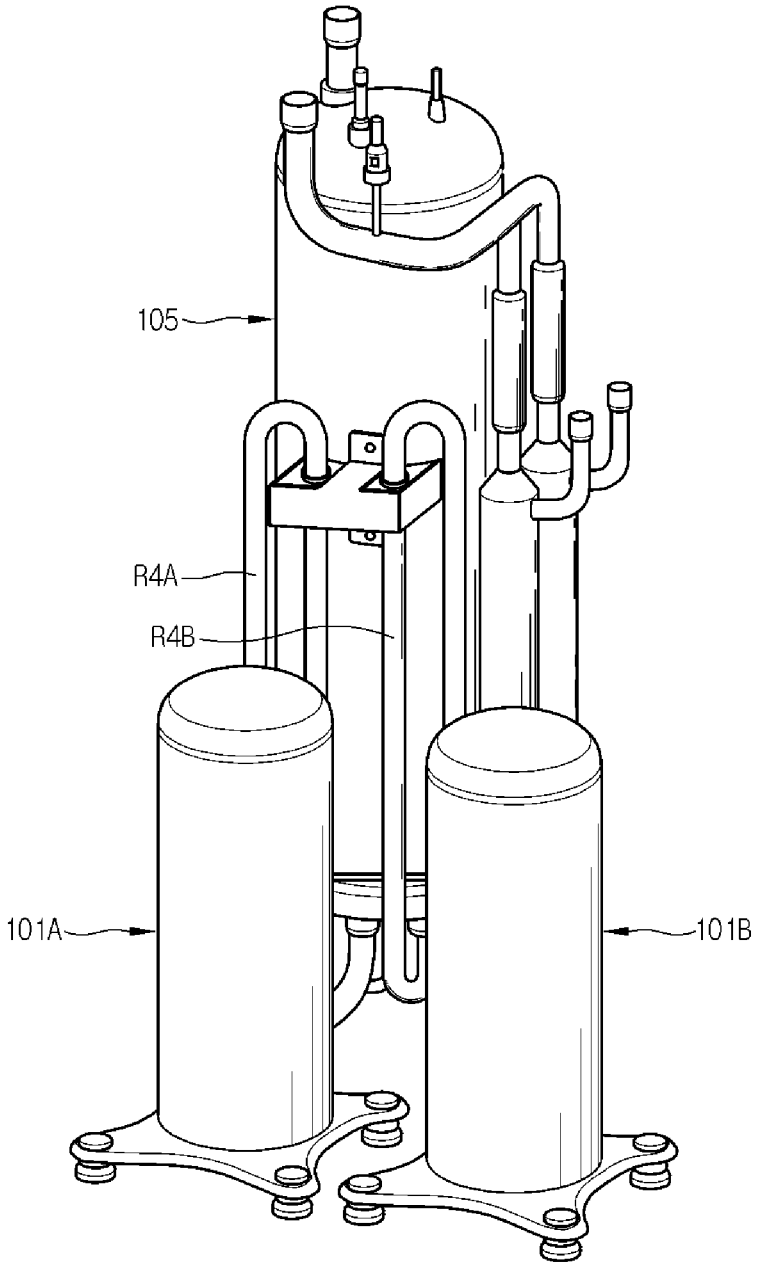

【Fig. 6】
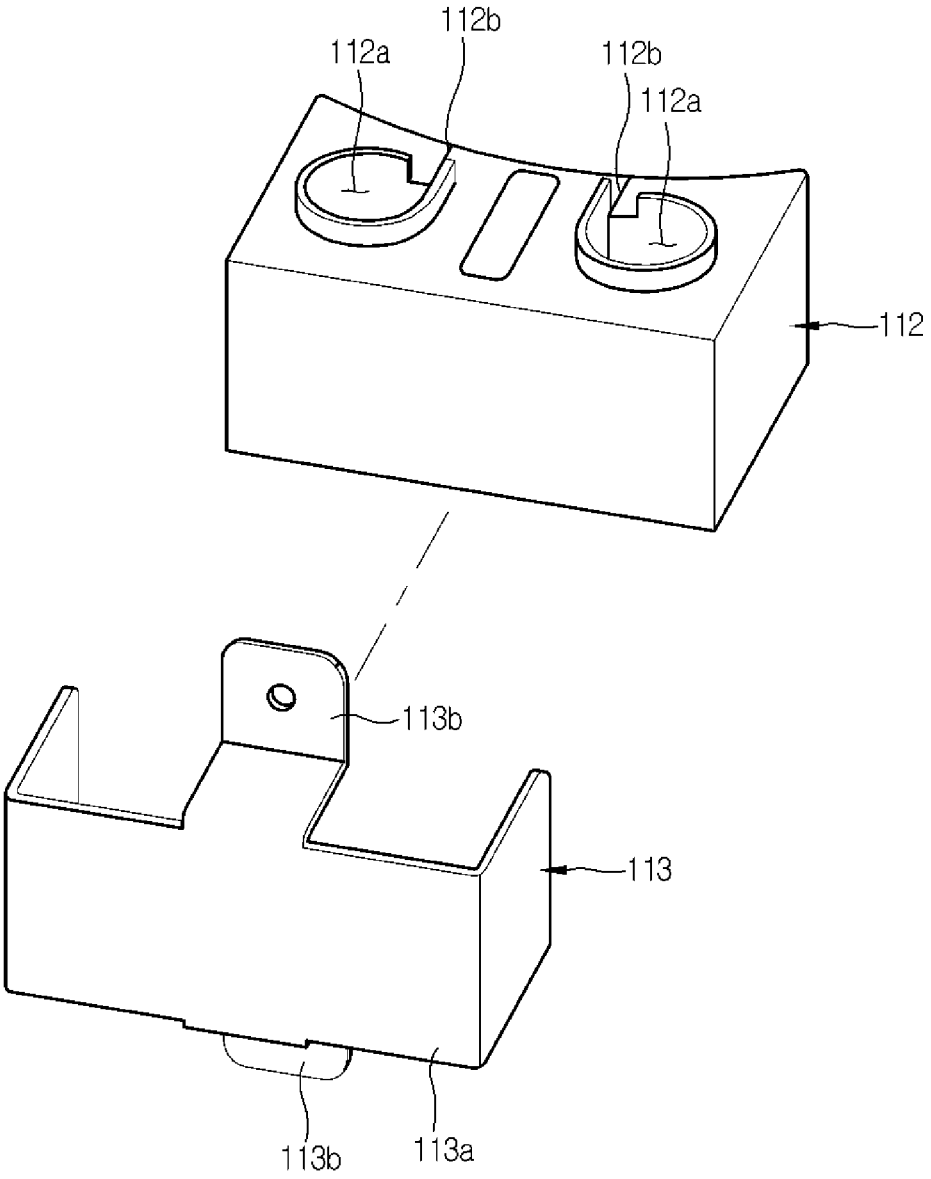

【Fig. 7】
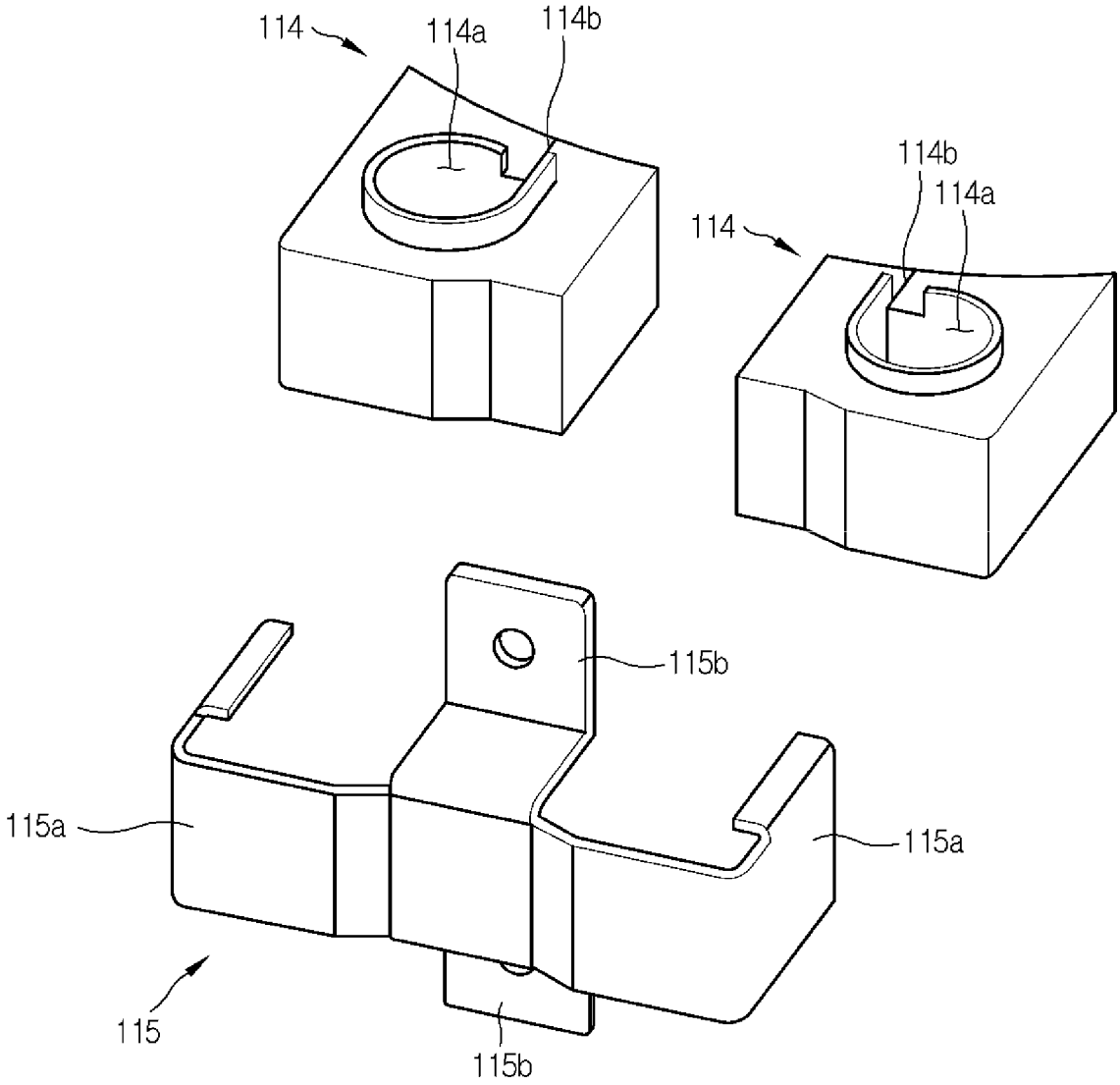

【Fig. 8】
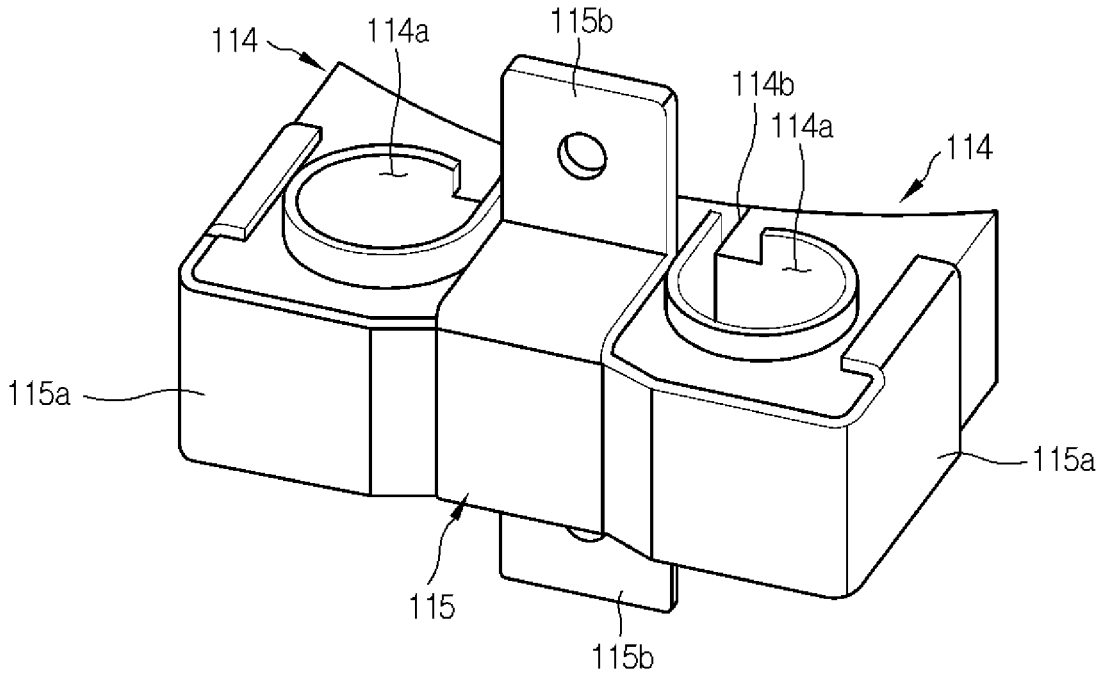

【Fig. 9】
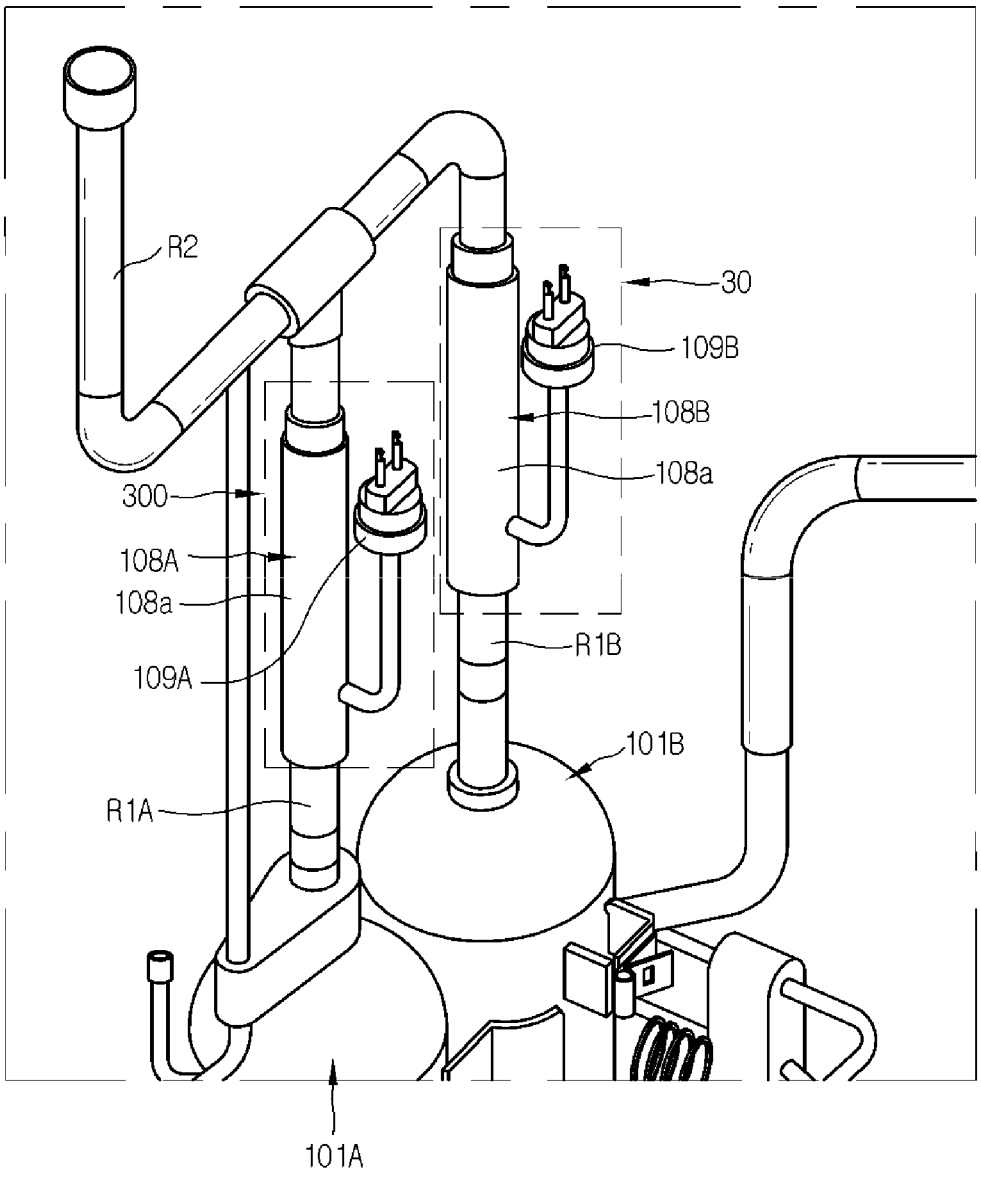

【Fig. 10】
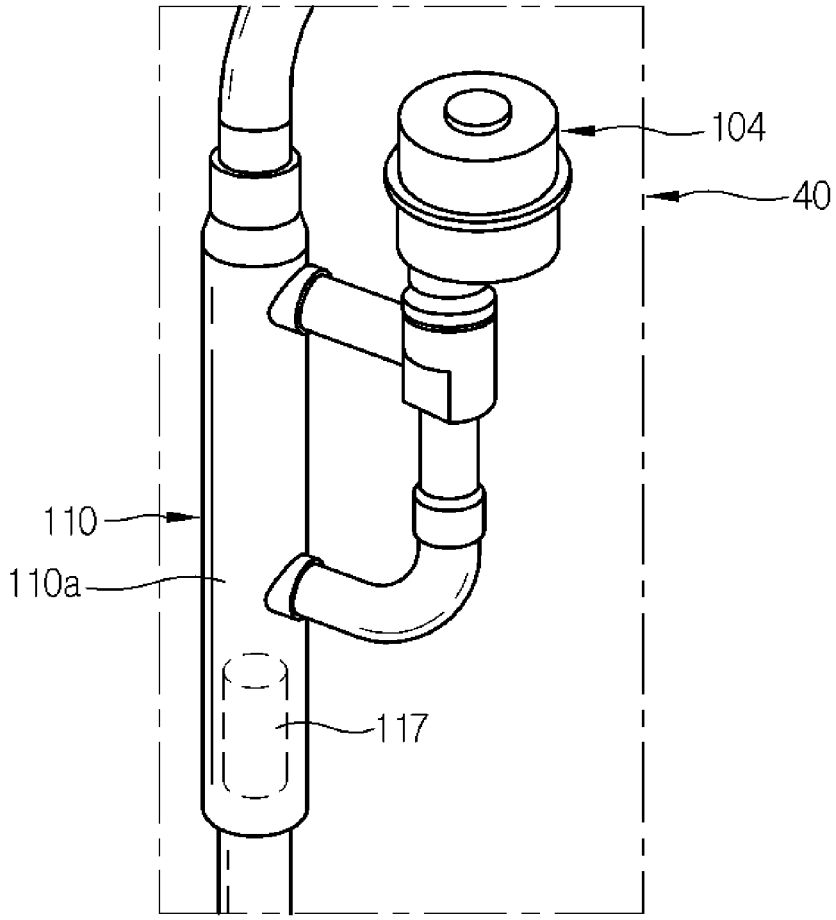

AIR-CONDITIONING SYSTEM

CROSS-REFERENCE TO RELATED APPLICATIONS

This application is a National Phase Application under 35 U.S.C. § 371 of PCT International Patent Application No. PCT/KR2016/011690, filed Oct. 18, 2016 which claims the foreign priority benefit under 35 U.S.C. § 119 to Korean Patent Application No. 10-2015-0147978 filed Oct. 23, 2015, the contents of which are incorporated herein by reference.

TECHNICAL FIELD

The present disclosure relates to an air-conditioning system capable of performing both a cooling operation and a heating operation.

BACKGROUND ART

Generally, an air-conditioning system includes a single outdoor unit installed in an outdoor space and a plurality of indoor units installed in a plurality of indoor spaces and is configured to cool and heat the plurality of indoor spaces by distributing and supplying a refrigerant to the plurality of indoor units through the single outdoor unit.

The outdoor unit includes a compressor compressing a refrigerant, an outdoor heat exchanger exchanging heat with outdoor air, an outdoor expansion valve allowing a refrigerant to be decompressed and expanded before being transferred to the outdoor heat exchanger during heating, and a four-way valve guiding a refrigerant discharged from the compressor to any one of the indoor unit and the outdoor heat exchanger. Each of the plurality of indoor units includes an indoor heat exchanger exchanging heat with indoor air, and includes an indoor expansion valve allowing a refrigerant to be decompressed and expanded before being transferred to the indoor heat exchanger during cooling. Thus, the air-conditioning system may selectively perform a cooling operation and a heating operation by switching between the cooling operation and the heating operation.

DISCLOSURE

Technical Problem

One aspect of the present disclosure provides an air-conditioning system capable of supplying an optimal amount of a refrigerant required for a cooling operation or a heating operation by filling a reservoir with a liquid refrigerant in less time.

Another aspect of the present disclosure provides an air-conditioning system including two suction pipes independently transferring a refrigerant from a single accumulator to two compressors and having a structure capable of evenly distributing and transferring oil to the two compressors.

Still another aspect of the present disclosure provides an air-conditioning system of which elements are more easily installed.

Technical Solution

According to an aspect of the present disclosure to provide an air-conditioning system including a compressor configured to compress a refrigerant, an indoor heat exchanger configured to allow the refrigerant to exchange heat with indoor air, an outdoor heat exchanger configured to allow the refrigerant to exchange heat with outdoor air, a four-way valve configured to guide the refrigerant discharged from the compressor to any one of the indoor heat exchanger and the outdoor heat exchanger, a first connection pipe configured to connect the outdoor heat exchanger and the indoor heat exchanger, a second connection pipe configured to connect the indoor heat exchanger and the four-way valve, an outdoor expansion valve disposed on the first connection pipe and configured to allow the refrigerant to be decompressed and expanded before being transferred to the outdoor heat exchanger during heating, a reservoir disposed on the first connection pipe between the outdoor heat exchanger and the outdoor expansion valve and configured to store the refrigerant, and a gaseous refrigerant guide pipe having one end connected to an upper end of the reservoir and configured to guide a gaseous refrigerant, wherein the first connection pipe comprises a first pipe portion having one end connected to the outdoor heat exchanger and the other end connected to a lower end of the reservoir, and a second pipe portion having one end connected to the outdoor expansion valve and the other end connected to a lower portion of the reservoir at a higher level than the other end of the first pipe portion, and the gaseous refrigerant guide pipe has the other end connected to the second pipe portion.

According to an another aspect of the present disclosure is an air-conditioning system including a compressor configured to compress a refrigerant, an indoor heat exchanger configured to allow the refrigerant to exchange heat with indoor air, an outdoor heat exchanger configured to allow the refrigerant to exchange heat with outdoor air, a four-way valve configured to guide the refrigerant discharged from the compressor to any one of the indoor heat exchanger and the outdoor heat exchanger, a first connection pipe configured to connect the outdoor heat exchanger and the indoor heat exchanger, a second connection pipe configured to connect the indoor heat exchanger and the four-way valve, an outdoor expansion valve disposed on the first connection pipe and configured to allow the refrigerant to be decompressed and expanded before being transferred to the outdoor heat exchanger during heating, and a reservoir disposed on the first connection pipe between the outdoor heat exchanger and the outdoor expansion valve and configured to store the refrigerant, wherein the first connection pipe comprises a first pipe portion having one end connected to the outdoor heat exchanger and the other end connected to a lower end of the reservoir, a second pipe portion having one end connected to the outdoor expansion valve and the other end connected to a lower portion of the reservoir at a higher level than the other end of the first pipe portion, and a third pipe portion disposed inside the reservoir and extending upward from the other end of the second pipe portion such that an upper end thereof is placed at an inner upper portion of the reservoir.

According to an another aspect of the present disclosure is an air-conditioning system including a first compressor and a second compressor, an accumulator configured to prevent a gaseous refrigerant from flowing into the first compressor and the second compressor, a first suction pipe and a second suction pipe configured to independently connect the accumulator and the first and second compressors, respectively, a main oil collection pipe configured to extend downward from a lower end of the accumulator and guide oil, and a first branching oil collection pipe and a second branch oil collection pipe configured to connect the first and second suction pipes and the main oil collection pipe, respectively.

The air-conditioning system may further include an oil collection valve disposed on the first branch oil collection pipe and configured to adjust an amount of oil supplied through the main oil collection pipe.

The air-conditioning system may further include a first discharge pipe configured to guide a refrigerant discharged from the first compressor, a second discharge pipe configured to guide a refrigerant discharged from the second compressor, a first oil separator disposed on the first discharge pipe, a second oil separator disposed on the second discharge pipe, a first oil collection pipe having one end connected to the first oil separator and the other end connected to the second suction pipe, and a second oil collection pipe having one end connected to the second oil separator and the other end connected to the first suction pipe.

According to an another aspect of the present disclosure is an air-conditioning system including a plurality of compressors, an accumulator configured to prevent a gaseous refrigerant from flowing into the plurality of compressors, a plurality of suction pipes configured to independently connect the accumulator and the plurality of compressors, respectively, at least one shock absorption member made of an elastically deformable material and having support holes in which the plurality of suction pipes are inserted and supported therein, and a shock absorption bracket configured to support an external surface of the at least one shock absorption member and fixed to the accumulator.

The at least one shock absorption member may include a plurality of shock absorption members into which the plurality of suction pipes are inserted, respectively.

The shock absorption members may have cut portions allowing the plurality of suction pipes to be inserted into the support holes.

According to an another aspect of the present disclosure is an air-conditioning system including a plurality of compressors configured to compress a refrigerant, a plurality of discharge pipes configured to guide the refrigerant discharged from the plurality of compressors, and a plurality of discharge check valve modules disposed on the plurality of discharge pipes, respectively, wherein each of the discharge check valve modules comprises a valve housing forming a channel and having a check valve disposed therein, and a high pressure switch connected to the valve housing and sensing that pressure of a refrigerant passing through the valve housing is greater than or equal to a certain value.

According to an another aspect of the present disclosure is an air-conditioning system including an outdoor heat exchanger, an indoor heat exchanger, a connection pipe configured to connect the outdoor heat exchanger and the indoor heat exchanger; and a check valve module connected to the connection pipe, wherein the check valve module comprises a valve housing forming a channel therein, on which a check valve is disposed, and an expansion valve connected in parallel to the valve housing through a refrigerant pipe.

The check valve module may further include a filter disposed in the valve housing and configured to filter a foreign substance.

Advantageous Effects

As described above, in an air-conditioning system according to an aspect of the present disclosure, even in a state in which a reservoir is being filled with a liquid refrigerant, a gaseous refrigerant transferred to the reservoir can be transferred to a second pipe portion. Thus, the reservoir can be rapidly filled with the liquid refrigerant.

In addition, since an air-conditioning system according to an aspect of the present disclosure includes a single accumulator and two compressors independently connected through two suction pipes, an oil collection pipe extending downward from a lower end of the accumulator, and two branch oil collection pipes connecting the oil collection pipe and the two suction pipes, so that oil collected in the accumulator can be suctioned into an operated compressor by a suction force applied to the suction pipe connected to the operated compressor. Thus, oil can be evenly distributed to the compressors.

Furthermore, in an air-conditioning system according to an aspect of the present disclosure, since a high pressure switch or an expansion valve is included in a check valve module, installation of the air-conditioning system is simplified.

DESCRIPTION OF DRAWINGS

FIG. 1 is a schematic view illustrating an air conditioning system according to the present disclosure.

FIG. 2 is a schematic view illustrating a reservoir applied to an air conditioning system according to an embodiment of the present disclosure.

FIG. 3 is a schematic view illustrating a reservoir applied to an air conditioning system according to another embodiment of the present disclosure.

FIG. 4 is a perspective view illustrating an arrangement of suction pipes, an oil separator, and oil collection pipes applied to the air conditioning system according to the embodiment of the present disclosure.

FIG. 5 is a perspective view illustrating an installation structure of suction pipes applied to an air conditioning system according to the embodiment of the present disclosure.

FIG. 6 is an exploded perspective view illustrating a shock absorption member and a shock absorption bracket for supporting suction pipes applied to the air conditioning system according to the embodiment of the present disclosure.

FIG. 7 is an exploded perspective view illustrating a shock absorption member and a shock absorption bracket for supporting suction pipes applied to an air conditioning system according to an another embodiment of the present disclosure.

FIG. 8 is a perspective view illustrating a shock absorption member and a shock absorption bracket for supporting suction pipes applied to the air conditioning system according to the another embodiment of the present disclosure.

FIG. 9 is a perspective view illustrating a discharge check valve module of the air conditioning system according to the another embodiment of the present disclosure.

FIG. 10 is a perspective view illustrating an outdoor check valve module in the air conditioning system according to the embodiment of the present disclosure.

MODES OF THE DISCLOSURE

Hereinafter, an air-conditioning system according to an exemplary embodiment of the present disclosure will be described in detail with reference to the accompanying drawings.

As shown in FIG. 1, the air-conditioning system according to the exemplary embodiment of the present disclosure includes an outdoor unit 100 installed in an outdoor space and a plurality of indoor units 200 installed in separate indoor spaces and connected to the outdoor unit 100 through refrigerant pipes to be described later.

The outdoor unit 100 includes compressors 101A and 101B compressing a refrigerant, an outdoor heat exchanger 102 exchanging heat with outdoor air, a four-way valve 103 selectively transferring the refrigerant discharged from the compressors 101A and 101B to any one of the outdoor heat exchanger 102 and an indoor heat exchanger 201 to be described later, an outdoor expansion valve 104 allowing a refrigerant guided to the outdoor heat exchanger 102 during heating to be decompressed and expanded before being transferred to the outdoor heat exchanger 102, an accumulator 105 preventing a gaseous refrigerant from flowing into the compressors 101A and 101B, an outdoor fan 106 allowing outdoor air to pass through the outdoor heat exchanger 102, and a reservoir 107 storing a refrigerant.

Each of the plurality of indoor units 200 includes the indoor heat exchanger 201 exchanging heat with indoor air, an indoor expansion valve 202 allowing a refrigerant guided to the indoor heat exchanger 201 during cooling to be decompressed and expanded before being transferred to the indoor heat exchanger 201, and an indoor fan 203 allowing indoor air to pass through the indoor heat exchanger 201.

The compressors 101A and 101B are realized as a scroll compressor and include a first compressor 101A and a second compressor 101B connected in parallel to each other. Therefore, any one or both the two compressors 101A and 101B can be allowed to be driven, thereby flexibly coping with a cooling load or a heating load needed in the air-conditioning system.

The outdoor expansion valve 104 and the indoor expansion valve 202 are each realized as an opening-adjustable electronic expansion valve to selectively decompress and expand refrigerants passing through the outdoor expansion valve 104 and the indoor expansion valve 202.

The reservoir 107 is to cope with a difference between an amount of a refrigerant required for cooling and an amount of a refrigerant required for heating. The reservoir 107 is disposed at a refrigerant pipe (first connection pipe R5 to be described later) between the outdoor expansion valve 104 and the outdoor heat exchanger 102 and stores a liquid refrigerant during cooling.

The accumulator 105 is provided as a single accumulator and is connected to the two compressors 101A and 101B through two suction pipes R4A and R4B to be described later, such that a refrigerant is independently transferred to the two compressors 101A and 101B therefrom.

In addition, the above-described elements are connected to one another through a plurality of refrigerant pipes such that a refrigerant is circulated. The refrigerant pipes included in the air-conditioning system include a first discharge pipe R1A and a second discharge pipe R1B guiding refrigerants discharged from the first compressor 101A and the second compressor 101B, respectively, a confluent pipe R2 having one end connected to the two discharge pipes R1A and R1B and the other end connected to the four-way valve 103 and guiding a refrigerant to the four-way valve 103, a collection pipe R3 having one end connected to the four-way valve 103 and the other end connected to the accumulator 105 and guiding a refrigerant to the accumulator 105, first and second suction pipes R4A and R4B independently connecting the accumulator 105 and the first and second compressors 101A and 101B, respectively, and allowing a refrigerant to be independently suctioned into the first and second compressors 101A and 101B, a first connection pipe R5 connecting the outdoor heat exchanger 102 and the indoor heat exchanger 201 and guiding a refrigerant from one heat exchanger of the outdoor heat exchanger 102 and the indoor heat exchanger 201 to the other heat exchanger, and a second connection pipe R6 connecting the four-way valve 103 and the indoor heat exchanger 201.

A first discharge check valve 108A and a second discharge check valve 108B are respectively disposed on the first discharge pipe R1A and the second discharge pipe R1B such that when only one compressor 101A or 101B of the two compressors 101A and 101B is driven, a refrigerant discharged through one discharge pipe of the two discharge pipes R1A and R1B is prevented from flowing backward to the other compressor 101A or 101B through the other discharge pipe R1A or R1B.

In addition, high pressure switches 109A and 109B are respectively disposed on the two discharge pipes R1A and R1B to sense whether the pressure of a refrigerant passing through the two discharge pipes R1A and R1B is greater than or equal to a certain value. Therefore, when the high pressure switches 109A and 109B sense that the pressure of the refrigerant is greater than or equal to the certain value, a sensing result indicating that the pressure of the refrigerant is greater than or equal to the certain value is transferred to a controller (not shown) configured to control the air-conditioning system. The controller can prevent overheating of the compressors 101A and 101B by stopping operations of the compressors 101A and 101B corresponding to the high pressure switches 109A and 109B.

Each of the above-described outdoor and indoor expansion valves 104 and 202 is disposed at the first connection pipe R5. The above-described reservoir 107 is disposed at the first connection pipe R5, i.e., between the outdoor expansion valve 104 and the outdoor heat exchanger 102. In addition, a bypass pipe B is connected to the first connection pipe R5 and allows a refrigerant to bypass the outdoor expansion valve 104 and pass through the first connection pipe R5 during a cooling operation.

The bypass pipe B is connected to the first connection pipe R5 and has both ends connected to both sides of the outdoor expansion valve 104. An outdoor check valve 110 is disposed at the bypass pipe B and allows a refrigerant to pass through the bypass pipe B only during cooling.

As shown in FIG. 2, the first connection pipe R5 includes a first pipe portion R5-1 having one end connected to the outdoor heat exchanger 102 and the other end connected to a lower end of the reservoir 107 and a second pipe portion R5-2 having one end connected to the outdoor expansion valve 104 and the other end connected to a lower portion of the reservoir 107, i.e., connected at a higher level than the other end of the first pipe portion R5-1.

In addition, a gaseous refrigerant guide pipe R5-3 is connected to the reservoir 107 such that a gaseous refrigerant remaining in the reservoir 107 is directly transferred from an upper portion of the reservoir 107 to the second pipe portion R5-2 during a cooling operation. The gaseous refrigerant guide pipe R5-3 has one end connected to an upper end of the reservoir 107 and the other end connected to the second pipe portion R5-2.

In a state in which a gaseous refrigerant remains in the reservoir 107 at the beginning of a cooling operation of the air-conditioning system, when the reservoir 107 is gradually filled with a liquid refrigerant transferred through the first pipe portion R5-1 from an inner lower portion thereof, the gaseous refrigerant is directly transferred to the second pipe portion R5-2 through the gaseous refrigerant guide pipe R5-3. Therefore, the reservoir 107 can be filled with the liquid refrigerant in a short time.

In addition, when the air-conditioning system performs a heating operation, a gaseous refrigerant decompressed and expanded by the outdoor expansion valve 104 is transferred to the reservoir 107. Therefore, the reservoir 107 is empty to merely serve as a channel through which a gaseous refrigerant passes.

In the present exemplary embodiment, the gaseous refrigerant is transferred to the second pipe portion R5-2 through the gaseous refrigerant guide pipe R5-3, but the present disclosure is not limited thereto. As shown in FIG. 3, a third pipe portion R5-4 connected to the second pipe portion R5-2 may be disposed inside the reservoir 107, and an upper end of the third pipe portion R5-4 may be disposed in an inner upper space of the reservoir 107.

As described above, when the third pipe portion R5-4 is disposed inside the reservoir 107, while the reservoir 107 is filled with a liquid refrigerant, a gaseous refrigerant flows into the third pipe portion R5-4 through the upper end of the third pipe portion R5-4 and then is transferred to the second pipe portion R5-2. Thus, the reservoir 107 can be rapidly filled with the liquid refrigerant.

As shown in FIG. 4, a main oil collection pipe O1 is connected to a lower end of the accumulator 105 to guide oil separated in the accumulator 105. The main oil collection pipe O1 extends downward from the lower end of the accumulator 105 such that oil is moved downward by its own weight. The main oil collection pipe O1 is connected to two branch oil collection pipes O2 and O3 connected to the two suction pipes R4A and R4B, respectively. In addition, an oil collection valve 111 is disposed on the main oil collection pipe O1 to adjust an amount of oil supplied through the main oil collection pipe O1.

In addition, the air-conditioning system according to the exemplary embodiment of the present disclosure includes a first oil separator 116A disposed on the first discharge pipe R1A and separating oil from a refrigerant discharged from the first compressor 101A, a second oil separator 116B disposed on the second discharge pipe R1B and separating oil from a refrigerant discharged from the second compressor 101B, a first oil collection pipe O4 having one end connected to the first oil separator 116A and the other end connected to the second suction pipe R4B, and a second oil collection pipe O5 having one end connected to the second oil separator 116B and the other end connected to the first suction pipe R4A.

Therefore, when both the first compressor 101A and the second compressor 101B are operated, oil collected in the first oil separator 116A is transferred to the second suction pipe R4B through the first oil collection pipe O4, and oil collected in the second oil separator 116B is transferred to the first suction pipe R4A through the second oil collection pipe O5. In addition, oil collected in the accumulator 105 is moved downward along the main oil collection pipe O1 by its own weight.

Since a suction force is applied to both the first suction pipe R4A and the second suction pipe R4B in a state in which both the first compressor 101A and the second compressor 101B are operated, oil transferred from the first oil separator 116A is suctioned into the second compressor 101B by the suction force applied to the second suction pipe R4B, and oil transferred from the second oil separator 116B is suctioned into the first compressor 101A by the suction force applied to the first suction pipe R4A. In addition, oil transferred from the accumulator 105 through the main oil collection pipe O1 is distributed and transferred to the two compressors 101A and 101B through the two branch oil collection pipes O2 and O3 and the two suction pipes R4A and R4B.

Next, a case in which any one of the first compressor 101A and the second compressor 101B is operated will be described.

Hereinafter, a case in which the first compressor 101A is operated and the second compressor 101B is not operated will be described as an example.

Since a refrigerant is discharged only through the first discharge pipe R1A in a state in which only the first compressor 101A is operated, oil is collected only in the first oil separator 116A disposed on the first discharge pipe R1A.

The oil collected in the first oil separator 116A is transferred to the second suction pipe R4B through the first oil collection pipe O4.

As described above, since the second compressor 101B is in a state of not being operated, a suction force is applied to the first suction pipe R4A but not to the second suction pipe R4B. Therefore, the oil transferred to the second suction pipe R4B sequentially passes through the second branch oil collection pipe O3 and the first branch oil collection pipe O2, is transferred to the first suction pipe R4A, and is supplied to the first compressor 101A by the suction force applied to the first suction pipe R4A.

In addition, the oil of the main oil collection pipe O1 collected in the accumulator 105 is distributed and supplied to the first compressor 101A through the first branch oil collection pipe O2 and the first suction pipe R4A by the suction force applied to the first suction pipe R4A.

That is, due to such a structure, when both the first compressor 101A and the second compressor 101B are operated, oil can be evenly distributed and supplied to the first compressor 101A and the second compressor 101B, and when any one of the first compressor 101A and the second compressor 101B is operated, oil can be supplied only to the compressor being operated among the compressors 101A and 101B.

As shown in FIGS. 5 and 6, parts of the middle sections of the two suction pipes R4A and R4B are installed at the accumulator 105 by a shock absorption member 112 and a shock absorption bracket 113 for installing the shock absorption member 112 on the accumulator 105. This is to prevent a vibration generated in the compressors 101A and 101B from being transferred to other elements through the suction pipes R4A and R4B.

The shock absorption member 112 is formed in an approximately quadrangular shape, and one surface thereof is formed in an arc shape to correspond to an external surface of the accumulator 105. The shock absorption member 112 has two support holes 112*a* in which the two suction pipes R4A and R4B are respectively inserted and supported therein, and has two cut portions 112*b* cut to be respectively connected to the two support holes 112*a* and allowing the suction pipes R4A and R4B to be respectively inserted into the two support holes 112*a*.

The shock absorption bracket 113 has a support portion 113*a* formed in an approximately U-shape and supporting an external surface of the shock absorption member 112, and has two fixed portions 113*b* extending from an upper end and a lower end of the support portion 113*a* and fixed to an outer peripheral surface of the accumulator 105.

In the present exemplary embodiment, the shock absorption member 112 is provided as a single shock absorption member, but the present disclosure is not limited thereto. As shown in FIGS. 7 and 8, two shock absorption members 114 may be provided and may be respectively installed at the two suction pipes R4A and R4B.

According to an exemplary embodiment, each of the two shock absorption members 114 has a support hole 114*a* in which the suction pipe R4A or R4B is inserted and supported therein, and has a cut portion 114*b* allowing the suction pipe R4A or R4B to be inserted into the support hole 114*a*.

A shock absorption bracket 115 has two support portions 115*a* formed in shapes corresponding to external surfaces of the two shock absorption members 114 and supporting the external surfaces of the two shock absorption members 114, and has two fixed portions 115*b* fixed to the external surface of the accumulator 105 and extending from an upper end and a lower end of a portion at which the two support portions 115*a* are connected.

Such a structure can be compatibly applied to an air-conditioning system including two compressors 101*a* and 101B as well as an air-conditioning system including only one compressor 101*a* or 101B, and thus can be used to fix one suction pipe R4A or R4B to the accumulator 105 using the single shock absorption member 114 and the shock absorption bracket 115.

In the present exemplary embodiment, the discharge check valve 108A and the high pressure switch 109A are installed at the first discharge pipe R1A, and the discharge check valve 108B and the high pressure switch 109B are installed at the second discharge pipe R1B, but the present disclosure is not limited thereto. As shown in FIG. 9, a discharge check valve module 300 may be installed at each of the first discharge pipe R1A and the second discharge pipe R1B.

The discharge check valve module 300 may include a valve housing 108*a* forming a channel on which a check valve is disposed, and may include the high pressure switch 109A or 109B connected to the valve housing 108*a* and sensing whether a pressure of a refrigerant passing through the valve housing 108*a* is greater than or equal to a certain value.

According to such a configuration, a process of installing the high pressure switches 109A and 109B can be omitted from processes of constituting the air-conditioning system, so that an installation of the air-conditioning system can be simplified.

In addition, in the present exemplary embodiment, the outdoor expansion valve 104, the bypass pipe B, and the outdoor check valve 110 are disposed at the first connection pipe R5, but the present disclosure is not limited thereto. As shown in FIG. 10, an outdoor check valve module 400 may be disposed at the first connection pipe R5.

The outdoor check valve module 400 includes a valve housing 110*a* forming a channel in which a check valve is disposed, and includes the outdoor expansion valve 104 connected in parallel to the valve housing 110*a* through a refrigerant pipe. In addition, the valve housing 110*a* may include a filter 117 filtering a foreign substance included in a refrigerant.

According to such a configuration, a process of installing the outdoor expansion valve 104 and the filter 117 can be omitted from the process of forming the air-conditioning system, so that an installation of the air-conditioning system can be simplified.

The present disclosure is not limited to the above-described exemplary embodiments and might be modified and amended in various forms not departing from the concept and scope of the present disclosure by an ordinary person skilled in the art. However, such modifications or changes belong to the scope of the claims of the present disclosure.

The invention claimed is:

1. An air-conditioning system comprising:

a compressor configured to compress a refrigerant;

an indoor heat exchanger configured to allow the refrigerant to exchange heat with indoor air;

an outdoor heat exchanger configured to allow the refrigerant to exchange heat with outdoor air;

a four-way valve configured to guide the refrigerant discharged from the compressor to any one of the indoor heat exchanger and the outdoor heat exchanger;

a first connection pipe configured to connect the outdoor heat exchanger and the indoor heat exchanger;

a second connection pipe configured to connect the indoor heat exchanger and the four-way valve;

an outdoor expansion valve disposed on the first connection pipe and configured to allow the refrigerant to be decompressed and expanded before being transferred to the outdoor heat exchanger during heating;

a reservoir disposed on the first connection pipe between the outdoor heat exchanger and the outdoor expansion valve and configured to store the refrigerant; and a gaseous refrigerant guide pipe having one end connected to an upper end of the reservoir and configured to guide a gaseous refrigerant, wherein the first connection pipe comprises a first pipe portion having one end connected to the outdoor heat exchanger and the other end connected to a lower end of the reservoir, and a second pipe portion having one end connected to the outdoor expansion valve and the other end connected to a lower side portion of the reservoir at a higher level than the other end of the first pipe portion, and the gaseous refrigerant guide pipe has the other end connected to the second pipe portion.

2. An air-conditioning system comprising:

a compressor configured to compress a refrigerant;

an indoor heat exchanger configured to allow the refrigerant to exchange heat with indoor air;

an outdoor heat exchanger configured to allow the refrigerant to exchange heat with outdoor air;

a four-way valve configured to guide the refrigerant discharged from the compressor to any one of the indoor heat exchanger and the outdoor heat exchanger;

a first connection pipe configured to connect the outdoor heat exchanger and the indoor heat exchanger;

a second connection pipe configured to connect the indoor heat exchanger and the four-way valve;

an outdoor expansion valve disposed on the first connection pipe and configured to allow the refrigerant to be decompressed and expanded before being transferred to the outdoor heat exchanger during heating; and a reservoir disposed on the first connection pipe between the outdoor heat exchanger and the outdoor expansion valve and configured to store the refrigerant, wherein the first connection pipe comprises a first pipe portion having one end connected to the outdoor heat exchanger and the other end connected to a lower end of the reservoir, a second pipe portion having one end connected to the outdoor expansion valve and the other end connected to a lower side portion of the reservoir at a higher level than the other end of the first pipe portion, and a third pipe portion disposed inside the reservoir and extending upward from the other end of the second pipe portion such that an upper end thereof is placed at an inner upper portion of the reservoir.

* * * * *